US005681046A

United States Patent [19]

Lawrence

[11] Patent Number: 5,681,046

[45] Date of Patent: Oct. 28, 1997

[54] COMPATIBILITY GAME

[76] Inventor: Elliot C. Lawrence, P.O. Box 416, Trenton, N.J. 08603

[21] Appl. No.: 593,078

[22] Filed: Jan. 29, 1996

[51] Int. Cl.[6] ..... A63F 9/00

[52] U.S. Cl. ..... 273/459; 283/48.1

[58] Field of Search ..... 273/430, 431, 273/459; 283/48.1, 49, 50

[56] References Cited

U.S. PATENT DOCUMENTS

| | | | |
|---|---|---|---|
| 1,432,177 | 10/1922 | Goldman et al. | 283/48.1 |
| 4,566,698 | 1/1986 | Sneden . | |
| 5,054,775 | 10/1991 | Banks et al. . | |
| 5,193,818 | 3/1993 | Leeson . | |
| 5,230,517 | 7/1993 | Peacock . | |
| 5,375,846 | 12/1994 | Smith . | |

FOREIGN PATENT DOCUMENTS

| | | |
|---|---|---|
| 2126908 | 4/1984 | United Kingdom . |
| 2226502 | 7/1990 | United Kingdom . |

*Primary Examiner*—Paul E. Shapiro

*Attorney, Agent, or Firm*—Richard C. Litman

[57] ABSTRACT

A compatibility game provides a series of questions in several categories relating to personal traits and characteristics, which a player may ask of two or more respondents. The player provides a numerical value for each response, in accordance with the degree to which that response agrees with the needs and desires of the player. The aggregate numerical response totals may be added and/or averaged to provide a relative ranking of compatibility between the player and each of the respondents. The present game is primarily intended for use between members of the opposite sex, with a player being of one sex (e.g., male) and the plural respondents being of the sex opposite the questioning player. While the game is primarily intended for entertainment purposes, it can serve as a way to "break the ice" at various gatherings, and for individuals to get to know more about one another and their common interests, or even provide some insight to the player as to potential partners. The game is well adapted for computer play, depending upon the specific program required for a given operating system and hardware, or alternatively may be played as a board game.

15 Claims, 4 Drawing Sheets

14a 14b 14c 14d 14e

| ENTER EACH CONTESTANT'S NAME OR NUMBER STARTING LINE 14a | ANNE 1 | BARBARA 2 | BETTY 3 | STELLA 4 | ZELDA 5 |
|---|---|---|---|---|---|
| A. PHYSICAL QUALITIES | | 24 | | | |
| 1. IS THIS PERSON GENERALLY ATTRACTIVE ? | 9 | 8 | 6 | 7 | 3 |
| 2. IS THIS PERSON IN GOOD HEALTH? | 8 | 9 | 10 | 9 | 9 |
| 3. IS THIS PERSON AT THIER PROPER WEIGHT ? | 8 | 10 | 8 | 10 | 7 |
| | | | | | |
| 9. IS THIS PERSON'S HAIR COLOR AND STYLE ATTRACTIVE? | 9 | 8 | 7 | 8 | 5 |
| 10. IS THIS PERSON'S HEIGHT COMPATIBLE ? | 9 | 9 | 7 | 10 | 8 |
| POINTS FOR THIS CATEGORY | 85 | 88 | 78 | 83 | 72 |
| DIVIDED BY NUMBER OF QUESTIONS | 10 | 10 | 10 | 10 | 10 |
| AVERAGE FOR CATEGORY | 8.5 | 8.8 | 7.8 | 8.3 | 7.2 |
| B. INTELLIGENCE AND EDUCATION | | | | | |
| 11. HOW INTELLIGENT DO YOU FIND THIS PERSON ? | 10 | 9 | 10 | 6 | 10 |
| 12. DOES THIS PERSON HAVE ANY SPECIAL SKILLS ? | 10 | 8 | 8 | 5 | 7 |

26 18 22 18 22 28 30 32 26 18 22

20 12a 12b 12c 12d 12e 10

*Fig. 1A*

20 12a 24 12c 12d 12e

| | | | | | |
|---|---|---|---|---|---|
| 95. ARE THIS PERSON'S INTERESTS IN PHYSICAL SPORTS COMPATIBLE ? | 5 | 7 | 9 | 4 | 0 |
| 96. ARE THIS PERSON'S PREFERENCES IN FOODS AND DINING COMPATIBLE ? | 9 | 8 | 10 | 6 | 8 |
| 97. ARE THE LEISURE TIME INTERESTS OF THIS PERSON, COMPATIBLE ? | 9 | 7 | 10 | 6 | 4 |
| 98. DOES THIS PERSON ENJOY MENTAL AND TECHNICAL PURSUITS SIMILAR TO YOUR INTERESTS ? | 10 | 7 | 9 | 3 | 7 |
| 99. DOES THIS PERSON ENJOY COMPATIBLE HANDCRAFTS ? | 8 | 7 | 9 | 5 | 6 |
| 100. DOES THIS PERSON HAVE ANY PETS SIMILAR TO YOUR PREFERENCES ? | 10 | 8 | 10 | 0 | 3 |
| POINTS FOR THIS CATEGORY / DIVIDED BY NUMBERS OF QUESTIONS | 91/10 | 80/10 | 87/10 | 52/10 | 48/10 |
| AVERAGE FOR CATEGORY | 9.1 | 8.0 | 8.7 | 5.2 | 4.8 |
| TOTAL SCORE, ALL CATEGORIES / DIVIDED BY NUMBERS OF CATEGORIES | 92/10 | 88/10 | 75/10 | 82/10 | 64/10 |
| FINISH LINE | 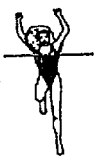 | 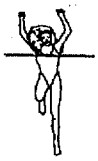 | 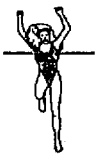 | 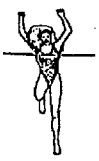 | 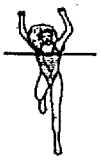 |
| FINAL RATINGS | 9.2 | 8.8 | 7.5 | 8.2 | 6.4 |
| RANK | ANNE FIRST PLACE | BARBARA SECOND PLACE | BETTY FOURTH PLACE | STELLA THIRD PLACE | ZELDA FIFTH PLACE |

18 18 22 28 30 32 34 36 40 38 42

*Fig. 1B*

COMPATIBILITY GAME

FIELD OF THE INVENTION

The present invention relates generally to games adapted for computer and board play, and more specifically to a game in which a single player develops relative compatibility ratings or rankings for a plurality of persons, in comparison to the player of the game. The ratings are developed either by asking persons various questions and ranking their responses on a numerical scale (and/or by developing hypothetical responses for persons, and ranking those hypothetical responses). The responses are averaged to determine the compatibility of the responding persons relative to the rankings given by the player, to determine the compatibility of the responding persons to the player. It should be noted that, in contrast to other related games, that the player of the present game does not accrue any score, but rather provides a score in various categories to rate or rank other responding persons.

1. BACKGROUND OF THE INVENTION

A number of board games and computer games have been developed over the years, which deal with personalities and personal relationships of real or hypothetical persons and the player or players of the game. These games are generally of the "twenty questions" type, wherein a player asks a series of questions and attempts to deduce the identity of the object of the questions from the responses to the questions. In some cases, the questions may relate to characteristics of another person known by the questioner or player, but no comparisons are made between that person and the questioner or player.

While such games are entertaining, they provide few or no objective or subjective results in judging the characteristics of the object person of the questioning, nor any compatibility of that person to the questioner. Also, no games known to applicant provide any means of comparison between various hypothetical or actual persons subject to questioning. This is unfortunate, as oftentimes it is difficult to determine if another person may be compatible with one's own personality and interests.

Accordingly, what is needed is a game in which a player may ask actual questions of a plurality of other individuals, and/or develop hypothetical responses from persons, in order to determine the compatibility of any of those persons to the player. The game may be represented as a track or other competition between the persons who are the objects of the questioning, with the "winner," i. e., the person achieving the highest total score or average score, being most compatible with the questioning player. The game should be adaptable both to board play and also to computer play, with the provision of a suitable program, depending upon the operating system and hardware of the computer.

2. DESCRIPTION OF THE PRIOR ART

U.S. Pat. No. 4,566,698 issued to Marcia A. Sneden on Jan. 28, 1986 describes a Character Identity Game involving a rectangular game board and a series of clues relating to the identity of an actual or fictional character. Several steps are involved on the board, but no "competition" is involved between the characters whose identity is being determined by the players, no questions are asked directly to any persons, and no compatibility is determined between characters and players.

U.S. Pat. No. 5,054,775 issued to Silvia Banks et al. on Oct. 8, 1991 describes a Game Relating To Personal Relationships wherein a plurality of players each question one another in accordance with questions and categories drawn randomly from a plurality of such questions and four categories. The only two categories requiring a response from the player being questioned are true and false, with all of the questions being answerable as yes or no, and provide no quantitative responses. Scoring is accomplished randomly, by tossing dice to determine a point value for "correct" answers, which are apparently judged by the questioner as to their correctness. No attempt is made as to objectivity, due to the chance scoring means, nor is any disclosure made by Banks et al. that their game enables a player to determine the compatibility of other players, or other persons, to that player.

U.S. Pat. No. 5,193,818 issued to Garry Leeson on Mar. 16, 1993 describes a Game in which players are shown a photograph of a well known personality, fictional character, etc. and given the opportunity to identify the person or character. If no immediate identification is made, a series of questions may be asked of the players, with a correct respondent continuing so long as he/she continues to respond correctly. Points are accrued by the players in accordance with their correct responses. No determination of compatibility of the personality or character with any of the players, is made by the Leeson game. The questions are purely objective, with points being awarded strictly according to a right or wrong answer; no subjective partial scores are possible, as in the present game.

U.S. Pat. No. 5,230,517 issued to Marlin L. Peacock on Jul. 27, 1993 describes a Method Of Playing A Game For Fostering Personal Relationships, in which an equal number of male and female players alternatingly ask one another questions relating to communication, sex, and commitment. A respondent who refuses to answer a given question must act according to some other random instruction as provided for on another group of cards. Each player records a series of "randomly received scores" (col. 4, line 12) which that player has awarded to each of the players of the opposite sex, in accordance with their responses to the questioning player. The Peacock disclosure fails to describe any means for computer play of his game, which is provided for in at least one embodiment of the present invention. The present game utilizes a single player, who questions in turn a plurality of respondents and objectively records the value of their responses according to personal values and preference. No random scoring is provided by the present game, nor are any penalties provided for failure to ask or answer a question.

U.S. Pat. No. 5,375,846 issued to Robert J. Smith on Dec. 27, 1994 describes a Sexual Etiquette Game Apparatus And Method, wherein players ask one another in turn to respond to various potentially sensitive situations or dilemmas, as provided on a series of cards. No score is maintained, but after all the cards have been gone through, each player rates him/herself and all other players subjectively according to their responses. The player with the highest rating is considered to have won the game. However, the Smith game fails to provide any means for the determination of compatibility between players, or for computer play, as provided by the present game.

British Patent Publication No. 2,126,908 to John A. Sutton et al. and published on Apr. 4, 1984 describes A Board Game Concerned With The Personality Of The Players, comprising a hexagonal board with six triangular areas therein, each divided into a series of smaller hexagonal playing spaces and relating to different personality traits or characteristics. The object of the game is to advance playing tokens across the playing board to a predetermined end point, in accordance with the answers given to various questions relating to such personality traits and characteristics. The winner is the player who first reaches the opposite side of the board, and who is closest to his/her predetermined end point. No relative rankings of persons is provided; rather, success in the game appears to be based primarily on self knowledge, rather than upon determining the traits of others.

Finally, British Patent Publication No. 2,226,502 to Jeffrey Cartwright and published on Aug. 4, 1990 describes a Board Game; Rocker Device, comprising a game board having a circular layout and a plurality of rocker devices generally representing stimulus and response at the two opposite sides, with emotions in the center. The object is to provide responses to a series of cards, which responses provide a generally centralized response along the rocker devices. Dice are also used to determine random moves. No ranking of other persons relative to the player(s) is provided by Cartwright, as provided by the present game, and further, the present game does not use any random chance means for play.

None of the above noted patents, taken either singly or in combination, are seen to disclose the specific arrangement of concepts disclosed by the present invention.

SUMMARY OF THE INVENTION

By the present invention, an improved compatibility game is disclosed.

Accordingly, one of the objects of the present invention is to provide an improved compatibility game which is adaptable for computer play with appropriate programming, depending upon the operating system and hardware, or which is alternatively adaptable to play as a board game.

Another of the objects of the present invention is to provide an improved compatibility game in which a single player asks a series of questions of a plurality of other persons, and provides subjectively and objectively obtained numerical values to their responses to provide a relative compatibility rating between the player and each of the respondents, with the questioning player receiving no score.

Yet another of the objects of the present invention is to provide an improved compatibility game in which the questions may be grouped in different subject areas, such as physical appearance, intelligence, education, interests, and/or other subject areas.

Still another of the objects of the present invention is to provide an improved compatibility game in which the numerical values awarded to each respondent after a series of questions, is used to provide a display of relative positions of the respondents along a computerized or game board playing path as the game progresses.

A further object of the present invention is to provide an improved compatibility game which preferably includes ten questions in each category and ten categories, but which may alternatively include more or fewer questions and categories as desired.

An additional object of the present invention is to provide an improved compatibility game in which the responses in any one category or subject area may be averaged, and those averages again averaged with one another at the end of the game, in order to provide a single numerical rating for each respondent.

Another object of the present invention is to provide an improved compatibility game which may be used by a person to rate or rank members of the opposite sex, in order to provide an estimate of compatibility between potential mates or life partners in an entertaining manner, which may be used as desired by persons for the above purpose in addition to other factors.

Yet another object of the present invention is to provide an improved compatibility game which includes means for determining the suitability of respondents, as a chart or other graphical device, when the final scores or rankings have been determined.

A final object of the present invention is to provide an improved compatibility game for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

FIGS. 1A and 1B are representations of a series of questions and categories which may be used in the present game, as they might appear on a game board or computer screen during play.

Similar reference characters denote corresponding features consistently throughout the figures of the attached drawings.

DETAILED DESCRIPTION OF THE PREFERRED EMBODIMENT

Figure 2:
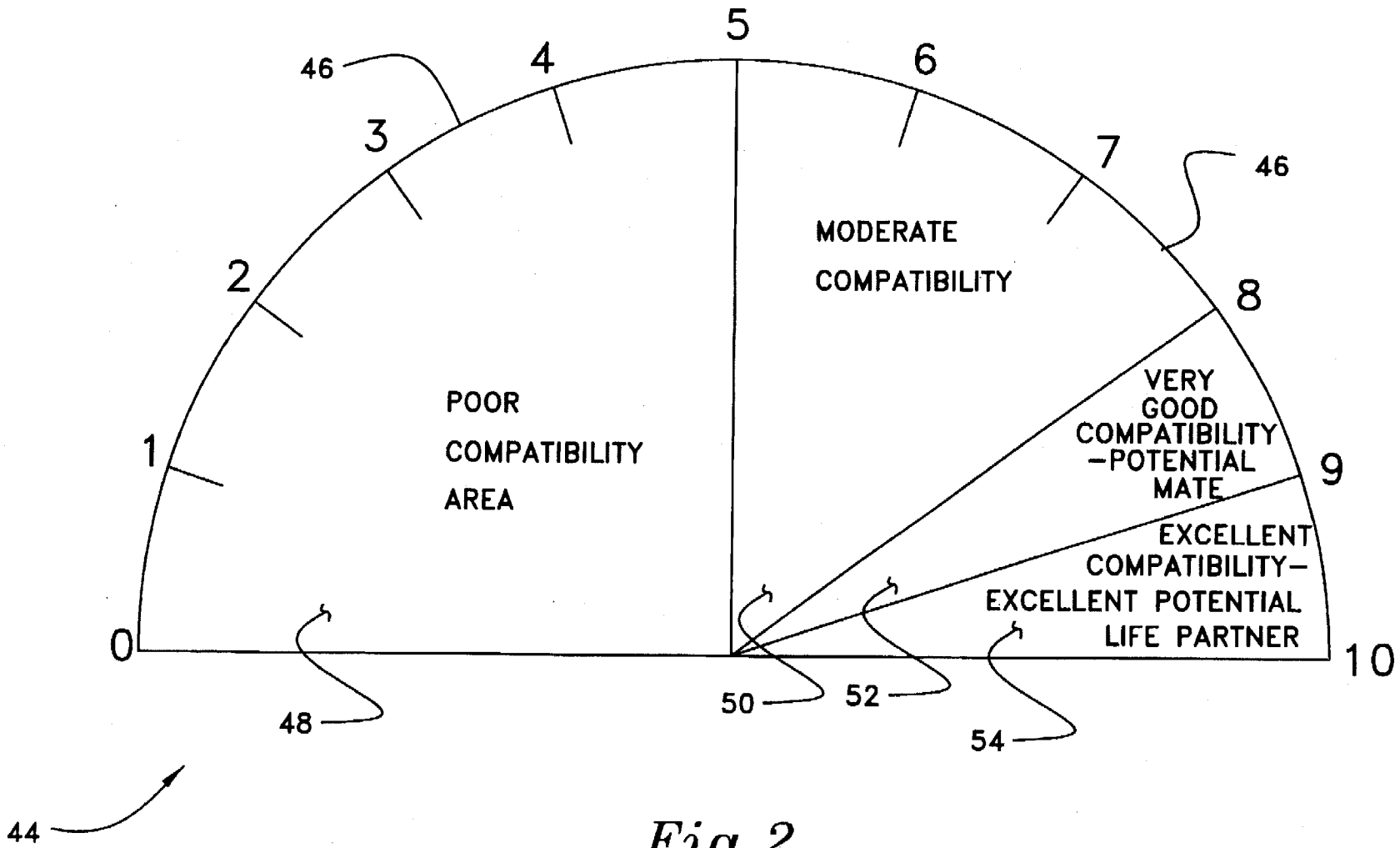
FIG. 2 is a compatibility rating or comparison chart, which may be used at the completion of the questioning portion of the game to provide an approximation of the suitability of various respondents as partners for the questioning player of the game.

Referring now particularly to FIGS. 1A and 1B of the drawings, the present invention will be seen to relate to a compatibility game, in which a single player acting as a questioner, provides a series of questions for a plurality of respondents and rates those respondents in terms of their compatibility with the player. The present game is well adapted for play on a computer, with the score sheet 10 capable of being provided in the form of an interactive computer display. Alternatively, the score sheet 10 may be provided as a hard copy and/or on a game board, if desired. In any case, the score sheet 10 includes a plurality of columns 12*a* through 12*e* representing lanes of a running track or other competitive arena. The columns or lanes 12*a* through 12*e* correspond to a plurality of respondents, which respondents are represented by the icons (in the case of computer play) or position markers (in the case of board game play) 14*a* through 14*e*, at the starting line 16. The number of lanes 12 may be fewer or greater than that shown, so long as the desired number of respondents participating in the game are accommodated and represented.

It should be noted that while the markers or icons 14*a* through 14*e* at the starting line 16 represent female figures, male figures or other symbolic markers may be substituted as desired. In the present example of the compatibility game of the present disclosure, a male player or questioner is assumed, who is using the present game as an entertaining means to select a most compatible female respondent for a possible future relationship. It will be seen that a female questioner may use the present game to perform the same function of a series of male acquaintances, and while the questions provided are preferably gender neutral for the broadest possible application, they may be narrowed to refer specifically to male or female characteristics, if desired.

It should also be noted that the term "respondent" is being used, rather than "contestant," although in some cases the respondents may be competing with one another for favorable status in the eyes of the player, who serves as the person (generally of the opposite sex) who is questioning the respondents and evaluating their responses in terms of numerical rankings. Thus, the player is not competing with the respondents, but rather is using the present game as a means to facilitate the selection of the best or most compatible respondent for a possible future relationship. However, the present game may be played simultaneously on additional levels, with respondents being provided with their own score sheets 10 (hard copies or computer generated), and may in turn question the first player or questioner, as well as other potential candidates. Thus, the present game lends itself well to an "ice breaker" for introductions at parties, initiations, and other events where persons of the opposite sex may be meeting for the first time.

The columns 12*a* through 12*e* may be provided with the actual names of the respondents, either by entering the names of the respondents on the computer, or by filling in the appropriate area immediately beneath each of the marker/icon starting positions on the score sheet 10. These names may be entered in alphabetical order across the top of the score sheet 10, as shown, by writing in the appropriate names or entering them via computer on a computer generated game. The alphabetical order is arbitrary, and any order may be used as desired. Alternatively, some players may desire a "blind" game, with only numbers or some other anonymous means used to designate the respondents, whereupon no names would be entered.

It should be noted that while it is implied that actual persons be present to provide actual responses to the questions asked by the questioning player in the present game, that this is not an absolute requirement. In the event that one or more of the respondents are not available, or if the response may be one of a nearly purely subjective nature, (or if one or more of the respondents declines to answer a particular question), the player may determine his own hypothetical response for the absent or non-responding (or even hypothetical) responder, if desired.

A plurality of questions 18 are provided in a column 20 along one side of the respondent columns or lanes 12*a* through 12*e*, with each of the questions 18 corresponding to a lateral row 22 across the score sheet 10. The space defined by the intersection of each responder column 12*a* through 12*e*, and each question row 20, provides for the entry of a numerical value 24 therein, with each of the values 24 being determined by the questioning player in accordance with the response provided by the respective responder of the corresponding column 12*a* through 12*e* and question 18.

As an example of the above, the questioning player may ask each of the respondents in turn (or provide an appropriate numerical value himself, in consideration of purely subjective and physical attributes, or of the need to provide a hypothetical response) such as the second question of FIG. 1A, "Are you in good health?" Health problems may of course range from nil to major, with the questioning player placing an appropriate response in the lateral row extending across the columns 12*a* through 12*e* to the right of the above question. "Anne" may have some form of chronic but relatively minor health problem which could interfere with a relationship, and hence the questioner assigns a value of eight in the appropriate space. On the other hand, "Barbara" and "Stella" are in excellent health, and each receives a numerical value of ten in the appropriate spaces. While such considerations are to a certain extent subjective, it will be seen that they nevertheless contain some validity, particularly within the viewpoint of the questioning player.

Preferably, a relatively large number of questions are provided, in order to check a broad range of attributes, characteristics, and other features of the respondents, and to better average out any low numbers. For example, a questioning player may find one of the respondents to be somewhat overweight, but yet may share numerous common interests and background with that respondent and may feel that they may be quite compatible otherwise. Accordingly, the present game does not depend upon a single or even a relatively few numerical values, but quantifies a vast array of qualities in order to arrive at an overall compatibility "score" for each respondent.

Many of the above questions may be related, and hence may be capable of being grouped into a number of general categories 26, such as the category A, "Physical Qualities," of FIG. 1A. Other categories may comprise Intelligence and Education, indicated as category B in the bottom portion of FIG. 1A, or perhaps a category pertaining to hobbies and other leisure time interests and pursuits, as indicated by the last category of the end of the score sheet 10 shown in FIG. 1B. Several other categories may be included, such as religious interests, preferences, and moral values; family values; goals in life; family history and background; etc. A hard copy score sheet or game board may comprise several pages or sheets, while a computer game version will extend over several screens.

While not essential to the concept of the present game, preferably a series of ten questions are provided in each of ten categories, for a total of one hundred questions. This provides a ready means of averaging the totals for each respondent in each category if desired, as the questions in that category are completed. (Alternatively, the raw totals themselves may be used, but the additional step of averaging provides a smaller decimal number which is more easily ranked on a scale from zero to ten.) Accordingly, a line 28 is provided following the last question in each category 26, for the totaling of all points in that category by each of the respondents. The next line 30 immediately below the category point total line 26, represents the number of questions for the category, which number is divided into the category point total to arrive at line 32, the average for the category. This process may be repeated for each category, as indicated further in FIG. 1B.

As the points or numerical values 24 for each of the responses is entered on the score sheet 10, the program of a computerized version of the present game may automatically move the icons 14*a* through 14*e* along the score sheet 10 (as represented on the monitor screen), to provide a quickly recognizable indication of the relative positions of the respondents of the game. Alternatively, the player may manually move the position markers 14*a* through 14*e* along each of their respective columns 12*a* through 12*e*, to accomplish the same effect. This is generally indicated by the icons/markers 14*a* through 14*e*, which have been moved to the beginning of category B, Intelligence and Education, near the bottom of FIG. 1A, although it will be understood that in an actual game their placement would be staggered in accordance with the relative total numerical values of each of their respective respondents. This process continues to the end of the game, with a single marker indicating a highest numerical value total or highest average, being in the lead at the end of the game.

At the completion of the totaling and/or averaging of the responses for the last question of the game, all of the averages for each of the categories may be totaled and entered in the "Total Score, All Categories" line 34 of FIG. 1B. (It will be noted that in all likelihood, each of these numbers would comprise a decimal fraction. The fractional component of each of the numbers may be dropped, as indicated on line 34, if desired.) Each of the total score numbers of line 34 may then be divided by the number of categories (e. g., 10) as indicated on line 36 of FIG. 1B, to arrive at a "Final Ratings" line 38, below the icons of the finish line 40. A ranking line 42 ends the score sheet 10, with the names of each of the respondents and their relative placement.

The above described game provides a means of determining a relative likelihood of compatibility between a questioning player and each of the respondents participating in the game, but does little to determine if any of the respondents are particularly compatible with the player. For example, the highest placing respondent may have a final average of only 6.5, with all other respondents having lower averages. On a scale with a maximum of ten, this does not indicate particularly good compatibility for any of the (perhaps several) respondents.

Accordingly, the present game may also include means for comparing the compatibility of the player to each of the respondents in some form (tabular form, analog scale, vertical "thermometer" scale, etc.) in order that the player may be provided with at least a somewhat clearer idea of any chance of a possible future relationship with any of the respondents. FIG. 2 provides a view of such compatibility comparison means, in the form of a semicircular arcuate chart 44, i.e., generally one half of a "pie chart" configuration. The outer, arcuate edge of the chart 44 includes a scale 46 thereon, which may be divided from zero to ten, in accordance with the possible range of averaged values for each of the respondents. The chart 44 may be further divided into different sectors, i.e., a poor compatibility sector 48, moderate compatibility sector 50, very good sector 52, and excellent compatibility sector 54. The given averaged final values may be marked on the scale 46, with a line from the final value mark to the origin passing through one of the compatibility sectors 48 through 54 to indicate at least an approximate degree of compatibility between the player and the respective respondent accruing a particular numerical value.

While the above described use of the compatibility chart 44 of FIG. 2 is applicable to a board game configuration of the present game, it will be seen that a computerized version may provide such a chart 44 on screen at the end of the game, with each of the values of each of the respective respondents plotted thereon, with their name and/or number indicated. The various compatibility zones or sectors may be colored or otherwise shaded or differentiated, and at least the highest compatibility indication may flash or have some other form of differentiation to stand out well from the background, thus providing rapid interpretation of the results of the game. Also, while the scale 46 shown is linear, i.e., with the same spacing between equal values, such a scale may be in logarithmic or other form, to broaden or narrow certain sectors as desired.

Figure 3:
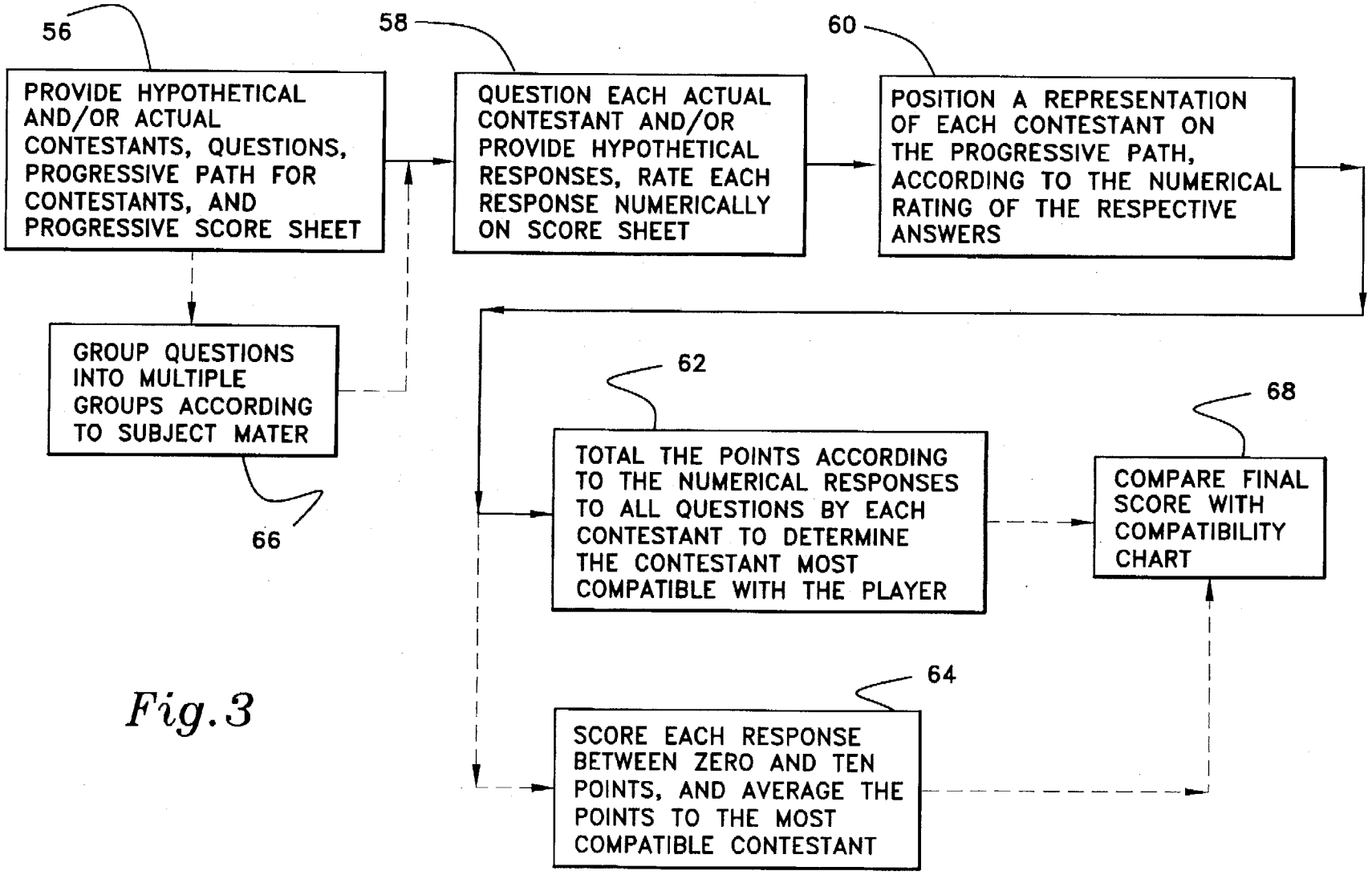
FIG. 3 is a flow chart providing a general disclosure of the steps involved in the play of the present compatibility game.

FIG. 3 provides a view of a generalized flow chart which shows the basic steps involved in the play of the present game. Once the player and respondents (called contestants in FIG. 3) have been determined and the game set up (or computer program initialized), as indicated in the first step 56 of FIG. 3, the player may then begin alternatingly asking each of the respondents or contestants various questions in turn relating to their compatibility with the questioning player. As noted further above, there may be instances in which an answer is not forthcoming for some reason or another, or where a respondent is not physically present (e. g., a celebrity figure whose characteristics are generally known to the questioner through fan magazines, etc.) where the player provides some hypothetical response. The responses are each given numerical values in accordance with their compatibility with the player, as indicated in the second step 58.

Preferably, these responses are ranked on some uniform scale, as from zero to ten, with the most compatible responses receiving the highest numerical rating or value. Other systems may be used arbitrarily, but the zero to ten scale has been found to provide a sufficiently fine gradation of responses for a reasonably meaningful result. While the scale may be reversed, with more closely compatible responses receiving lower numerical values, this would make it difficult to factor in situations where no response was possible for some reason or another. With higher ranking numerical values for more closely compatible responses, a non-response would receive a zero, as in a situation where no compatibility was perceived. Whatever the system used, each numerical value is entered in the corresponding space on the score sheet 10, either in hard copy form or via computer.

The present game is made more interesting when a plurality of icons or position markers, each representing one of the respondents or contestants, are placed along their respective columns or lanes on the score sheet and advanced according to their relative accrued scores or numerical values. This may be done manually in the case of board game play, or may alternatively be accomplished automatically in the case of a computerized game, as each numerical value is entered. The positions would be based upon a fraction of the total possible points or score for a perfectly compatible response or responses, and would provide an instant approximate indication of the relative rankings or placement of each of the respondents or contestants during the course of play. This is generally indicated as the third step 60 of FIG. 3.

The above process is continued until each of the respondents has answered each of the questions (or hypothetical responses have been provided, as appropriate), whereupon the numerical values for all responses are totaled in each lane or column of the score sheet. The respondent or contestant having the highest total is thus the person most compatible with the questioning player, as indicated generally in the fourth step 62 of FIG. 3.

As noted further above, a numerical value or point system scale ranging from zero to ten, with higher values being awarded for more compatible responses, has been found to work well in the present game; this is indicated in the optional step 64 of FIG. 3. (While this scoring system is preferred, it is not desired to limit the present game to only this system, and to allow other numerical value systems to be used if so desired. Hence, it is deemed an optional step.) In the same manner, the questions may be grouped according to subject matter to form multiple groups of related questions, in accordance with the optional step 66 depending from the first step 56 of FIG. 3.

Finally, the total numerical values or scores produced at the end of the game, may be entered on a compatibility chart, such as the chart 44 of FIG. 2, or other suitable graphic or other compatibility comparison means. This step is indicated generally as an optional final step 68 in FIG. 3. As in the other optional steps discussed above, this is a preferred step in the play of the present game, in order to provide an easily observed indication of the likelihood of compatibility of at least the highest scoring respondent or contestant, but the raw scores developed to this point will at least provide an indication of the most compatible respondent.

In summary, the present compatibility game and method of play will be seen to provide an enjoyable and entertaining means of determining (at least to some extent) the compatibility between a single first player and a plurality of respondents, by means of the player questioning the respondents in turn, using a plurality of questions relating to various personal attributes, features, and values of the respondents. While the game is not intended to be a rigorous psychological tool for the purpose of mutual compatibility or "matchmaking" between persons, it can serve as an enjoyable and entertaining "icebreaker" at parties and social gatherings where unattached persons (particularly of both sexes) are assembled.

In fact, while the present game is directed to a single player who provides a series of questions to a plurality of respondents, it will be seen that the game lends itself to play simultaneously by a plurality of players, in which each of the players may also be a respondent to questions put forth by each of the other respondents, particularly those of the opposite sex. In this way, all participants—the questioning player(s) and respondents—are on an equal footing relative to one another during the course of the game, with none of the participants being required to take a purely responding part and being unable to make her or his own judgments as to compatibility with the questioning player. In any event, while the game may serve as light entertainment for those involved, it will also be seen to enable persons to get to know one another better, and perhaps allow them to develop more meaningful relationships through this knowledge.

It is to be understood that the present invention is not limited to the sole embodiment described above, but encompasses any and all embodiments within the scope of the following claims.

I claim:

1. A method of playing a compatibility game adapted to provide an indication of compatibility between a questioning player and a plurality of respondents, said method comprising the following steps:

(a) providing a plurality of questions relating to the personal traits, characteristics, and other features and attributes of the respondents;

(b) having the questioning player question each of the respondents alternatingly in turn, in accordance with the plurality of questions provided;

(c) having the player assign a numerical value for each of the responses provided for each of the questions by each of the respondents, and;

(d) rating the respondents in accordance with the numerical values assigned to each of the responses, to determine the relative compatibility of each of the respondents to the questioning player.

2. The method of playing the compatibility game of claim 1, including the step of:

providing a scoring sheet having a plurality of playing paths each respectively corresponding with one of the respondents, with the scoring sheet further having a column having a plurality of questions thereon and disposed parallel to the plurality of playing paths.

3. The method of playing the compatibility game of claim 2, including the step of:

providing the scoring sheet and question column in the form of an interactive computer generated display.

4. The method of playing the compatibility game of claim 3, including the steps of:

(a) providing a plurality of icons each representing one of the respondents, and;

(b) advancing each of the icons along its respective one of the plurality of playing paths in accordance with the relative numerical values assigned to the corresponding respondent.

5. The method of playing the compatibility game of claim 2, including the step of:

providing the scoring sheet and question column in the form of a game board.

6. The method of playing the compatibility game of claim 5, including the steps of:

(a) providing a plurality of player position markers each representing one of the respondents, and;

(b) advancing each of the player position markers along its respective one of the plurality of playing paths in accordance with the relative numerical values assigned to the corresponding respondent.

7. The method of playing the compatibility game of claim 1, including the step of:

providing a compatibility comparison means for comparing the ratings resulting from the relative numerical values assigned to each of the respondents.

8. The method of playing the compatibility game of claim 7, including the step of:

providing the compatibility comparison means in the form of an interactive computer generated display.

9. The method of playing the compatibility game of claim 7, including the step of:

providing the compatibility comparison means in the form of a chart having comparative compatibility areas displayed thereon.

10. The method of playing the compatibility game of claim 1, including the step of:

providing higher numerical values for responses reflecting a greater degree of compatibility between the player and each of the respondents, and providing lower numerical values for responses reflecting a lesser degree of compatibility between the player and each of the respondents.

11. The method of playing the compatibility game of claim 10, including the step of:

providing numerical values on a scale from ten points for the greatest compatibility, to zero points for no compatibility between the questioning player and each of the respondents.

12. The method of playing the compatibility game of claim 1, including the step of:

averaging the numerical values of each of the responses of each of the responders, to provide an average response value for each of the responders.

13. The method of playing the compatibility game of claim 1, including the step of:

providing a plurality of different question subject areas.

14. The method of playing the compatibility game of claim 13, including the step of:

grouping questions in each of the different subject areas, in accordance with a corresponding one of the subject areas.

15. The method of playing the compatibility game of claim 14, including the steps of:

(a) averaging the numerical values of each of the responses of each of the responders in each of the subject areas, and;

(b) averaging the average numerical values of each of the averages of the subject areas, to provide an average response value for each of the responders.

* * * * *